US007687701B1

(12) United States Patent
Kushner

(10) Patent No.: US 7,687,701 B1
(45) Date of Patent: Mar. 30, 2010

(54) CASES FOR THE PROTECTION OF STRINGED MUSICAL INSTRUMENTS

(76) Inventor: Daniel Watson Kushner, 62 Hillview Ave., San Rafael, CA (US) 94901

( * ) Notice: Subject to any disclaimer, the term of this patent is extended or adjusted under 35 U.S.C. 154(b) by 0 days.

(21) Appl. No.: 12/069,607

(22) Filed: Feb. 11, 2008

(51) Int. Cl.
*G10D 9/00* (2006.01)

(52) U.S. Cl. ..... 84/453; 206/314

(58) Field of Classification Search ..... 84/453; 206/314

See application file for complete search history.

(56) References Cited

U.S. PATENT DOCUMENTS

| | | | | |
|---|---|---|---|---|
| 3,901,384 | A | 8/1975 | Lee et al. | 206/314 |
| 4,190,152 | A | 2/1980 | Reiter | 206/314 |
| 4,531,632 | A | 7/1985 | Weber | 206/14 |
| 4,846,340 | A | 7/1989 | Walther | 206/14 |
| 5,833,051 | A | 11/1998 | Tiefenbrun et al. | 206/14 |
| 6,029,804 | A | 2/2000 | Flynn | 206/14 |
| 6,283,287 | B1 | 9/2001 | Carl | 206/314 |
| 6,499,592 | B2 | 12/2002 | Wilfer | 206/314 |
| 6,670,536 | B2 * | 12/2003 | Godin et al. | 84/453 |
| D487,627 | S | 3/2004 | Izen et al. | D3/204 |
| 2006/0230905 | A1 * | 10/2006 | Stanley | 84/328 |

FOREIGN PATENT DOCUMENTS

JP 2002366143 A * 12/2002

* cited by examiner

*Primary Examiner*—Jianchun Qin
(74) *Attorney, Agent, or Firm*—The Patent Source

(57) ABSTRACT

Cases for the protection of stringed musical instruments having a bottom, a sidewall of a predetermined height extending from the bottom and a cover which is hingedly connected to the sidewall and which can be closed and secured with an appropriate fastener are described herein. The cases include a semi-rigid neck-brace having a height approximately the same as the inner height of the sidewall and being affixed to the bottom. The cases further include at least one retaining band that may be used to releasably secure the instrument neck to the neck-brace. Instrument damage may be prevented in the event of a sideways or backward fall, in at least part, because the neck-brace suspends the headstock between the bottom, sidewall and cover of the case and thereby prevents it from making contact.

20 Claims, 4 Drawing Sheets

CASES FOR THE PROTECTION OF STRINGED MUSICAL INSTRUMENTS

BACKGROUND OF THE INVENTION

1. Field of the Invention

The present invention is directed to apparatus and methods for the protection of musical instruments. More particularly, the invention relates to the field of stringed musical instrument cases which provide enhanced instrument protection and convenience. Accordingly, the general objects of the invention are to provide novel apparatus and methods of such character.

2. Description of the Related Art

The worldwide popularity of stringed instruments such as guitars, basses, cellos, violins, mandolins, ukuleles, etc in the last several decades has led to many advancements in these instruments as well as related accessories. One such accessory that has seen a wide variety of improvements is the protective case. Such cases are now available in a number of basic styles with a wide variety of materials and features that offer some combination of improved ergonomics, lower cost, lighter weight, and/or better protection. For example, instrument cases are now available in three basic styles (the soft case—or gig-bag—, the hard-shell case and the hybrid case). While gig-bags are generally considered very convenient, hard-shell cases are generally considered to provide better protection. Hybrid cases generally employ a combination of flexible and semi-rigid materials in an effort to approximate the benefits of both gig-bags and hard-shell cases. Naturally, many of these design goals conflict with one another and compromises/trade-offs have been the norm with hybrid cases.

Some examples of fairly recent instrument case designs are discussed immediately below to provide some additional background information.

U.S. Pat. No. 4,531,632 discloses a substantially rectangular case for string instruments such as violins, violas, or guitars with an inner displaceable wall which is displaced to adapt the case to instruments with different body sizes. The displaceable or movable wall has a cut-out section for cradling a neck of a stored string instrument. On opposite sides of the cut-out section, there are provided straps for holding the instrument neck tightly in place. The straps are equipped with a hook and loop fastener. A string instrument, when placed in the case has its neck tightly held with the straps. U.S. Pat. No. 4,531,632 issued Jul. 30, 1985 and entitled "Case For Stringed Instrument" is hereby incorporated by reference.

U.S. Pat. No. 4,190,152 discloses a rigid case for musical instruments, in particular for saxophones, which is equipped with means for preventing shifting of the instrument. The shifting-preventing means includes flexible spring restraints enveloped by rubber tubing. Both ends of the spring restraint are secured to braces which are secured to the case floor with screws, rivets, or glue. Alternatively, the spring restraint ends can be secured directly to the case floor. Instead of a spring restraint enveloped with rubber tubing, a band of an elastic material can be used. The fixation means surrounds the instrument, saxophone, securing it to the floor. There can be provided one or more restraints. However, the attachment of the restraint to braces is relatively expensive and can lead to bending of the braces. Of course, this type of restraints cannot be used with flexible cases. U.S. Pat. No. 4,190,152 issued Feb. 26, 1980 and entitled "Musical Instrument Carrying Case" is hereby incorporated by reference.

In an effort to overcome these deficiencies, the designs disclosed in U.S. Pat. No. 6,499,592 include at least one releasable band for releasably securing a stringed musical instrument to the bottom of a flexible instrument case or a rigid instrument case. These designs do represent an improvement over the aforementioned designs in that they can take the form of a gig-bag which is preferred by many musicians due to the convenience provided by its flexibility, generally smaller size and generally lower weight. Moreover, these designs protect stringed instruments better than a basic gig-bag in that the instrument cannot accidentally fall out of the case. However, these designs do not provide any protection to an instrument if a loaded gig-bag falls on its back. Since the headstock of many stringed instruments is angled backward relative to the fingerboard of the neck, the headstock is particularly vulnerable to breakage in this way. If such a fall occurs, the instrument is likely to incur substantial damage such as a headstock that breaks off of the end of the neck. U.S. Pat. No. 6,499,592 issued Dec. 31, 2002 and entitled "Case For Acoustic And/Or Electrical Instruments" is hereby incorporated by reference.

There is, accordingly, a need in the art for flexible stringed musical instrument cases with an instrument retaining/protection system which is suitable for a wide variety of stringed instruments and which greatly reduce the risk of an instrument being damaged or destroyed.

SUMMARY OF THE INVENTION

The present invention satisfies the above-stated needs and overcomes the above-stated and other deficiencies of the related art by providing a protective case for a stringed instrument having a bottom, a sidewall of a predetermined height extending from the bottom and a cover which is hingedly connected to the sidewall and which can be closed with an appropriate fastener. The case also includes a semi-rigid neck-brace having a height less than the height of the sidewall and being affixed to the bottom. The neck-brace includes at least one retaining band that may be used to realeasably secure the instrument neck to the neck-brace. With such retaining band(s), the instrument cannot fall out of the case if the cover fastener is defective or is damaged. Instrument damage may also be prevented in the event of lateral (side) impacts because of the at least one retaining band that may be used to releasably secure the instrument neck to the neck-brace, thereby preventing it from making contact with the sidewalls. Further, headstock damage may be prevented in the event of a backward fall because the height of the neck-brace suspends the headstock between the bottom and cover of the case to thereby prevent it from making contact with the ground or floor.

It will be appreciated that multiple restraining bands many be used if desired. Regardless of the number of restraining bands, the band(s) maybe resilient so that they may be tensioned to provide a desired amount of neck restraint. Additionally, the band(s) may be thin or wide but are preferably about the same length as the neck-brace and preferably includes a resealable pocket suitable for storing items such as instrument picks.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1A:
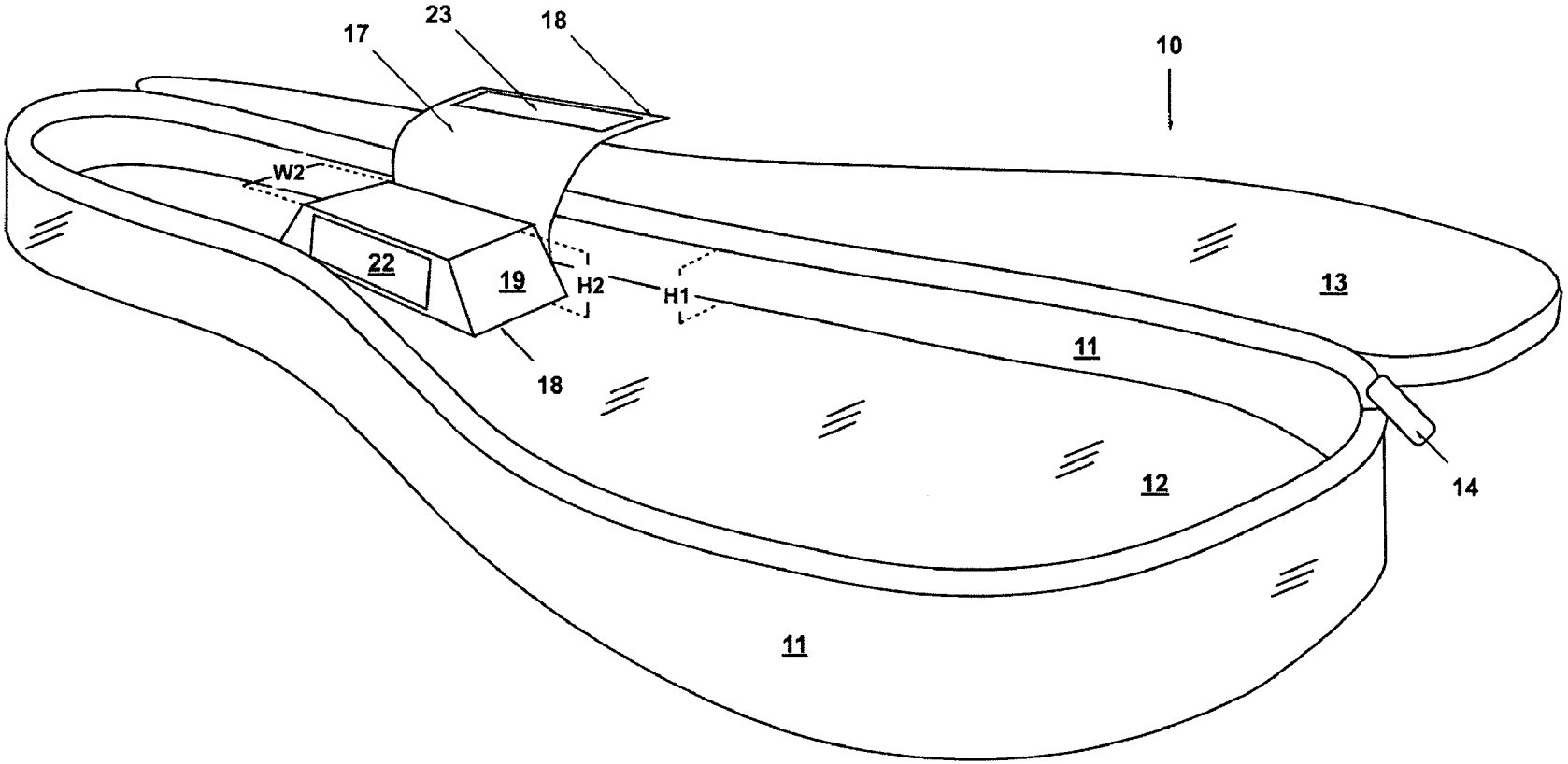
FIG. 1*a* is a perspective view of a protective case in accordance with one preferred embodiment of the present invention.
Figure 1B:
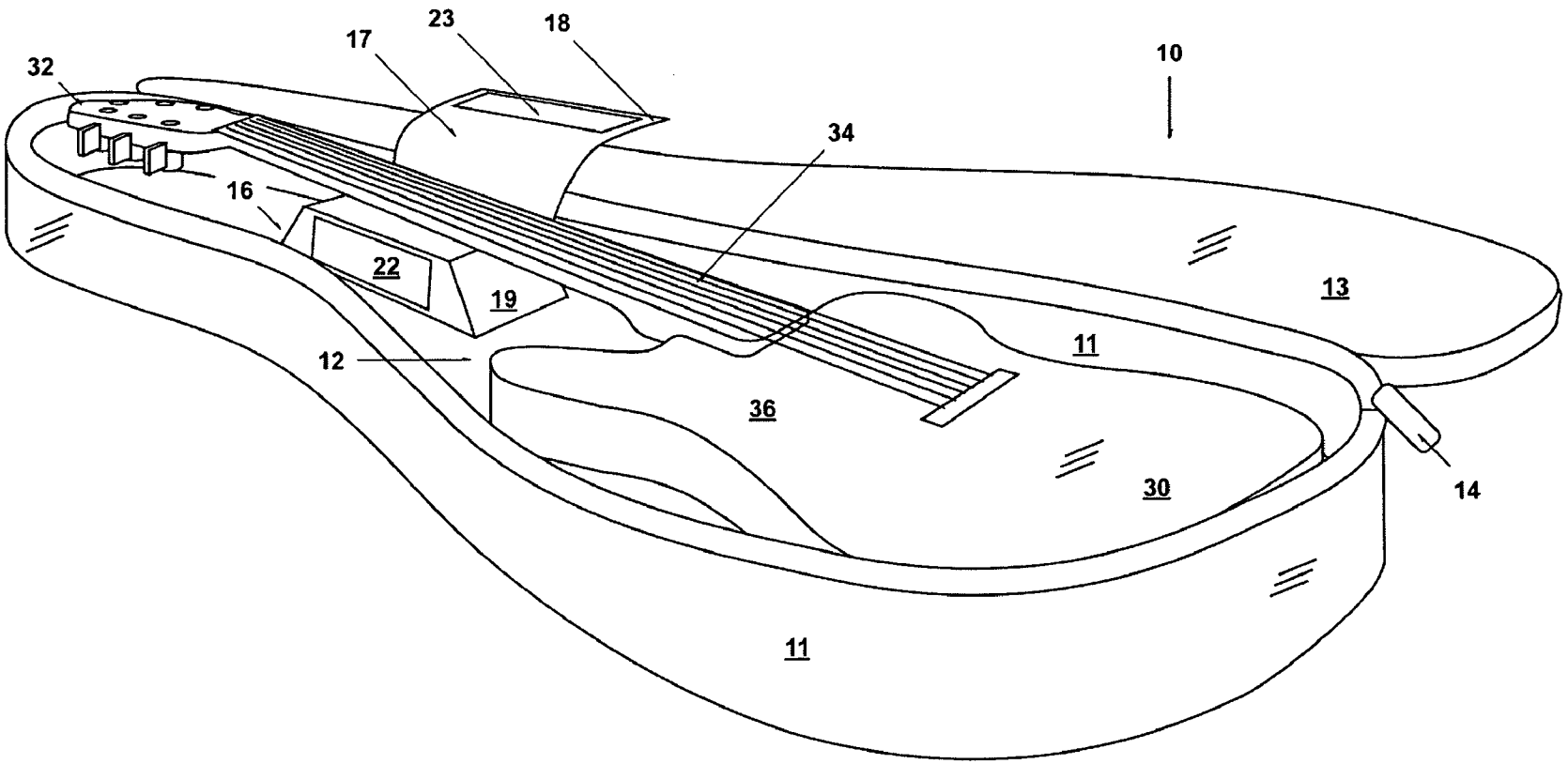
FIG. 1*b* illustrates the protective case of FIG. 1*a* wherein an instrument has been placed therein and wherein the retaining band remains unsecured.
Figure 1C:
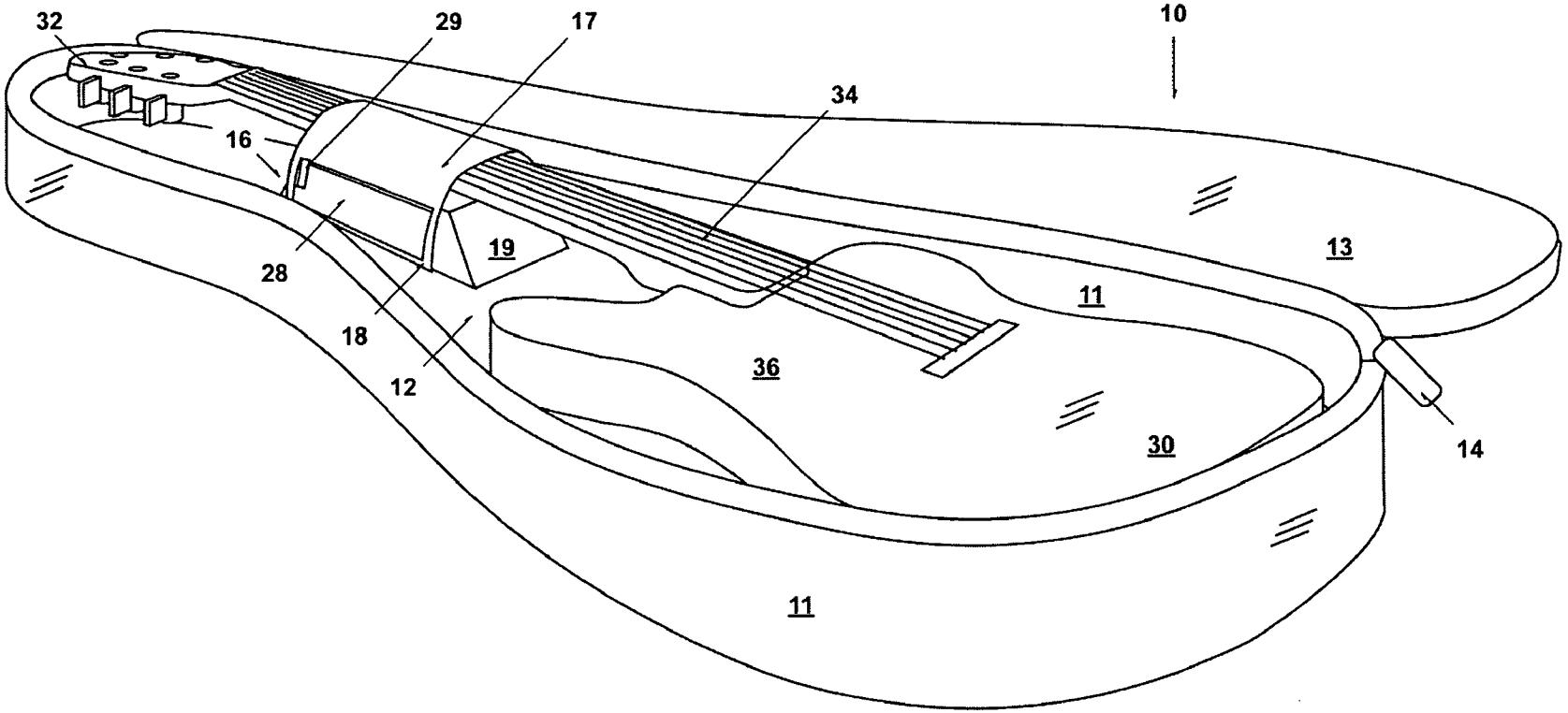
FIG. 1*c* illustrates the protective case of FIGS. 1*a* and 1*b* wherein an instrument has been placed therein and wherein the retaining band has been secured.
Figure 2:
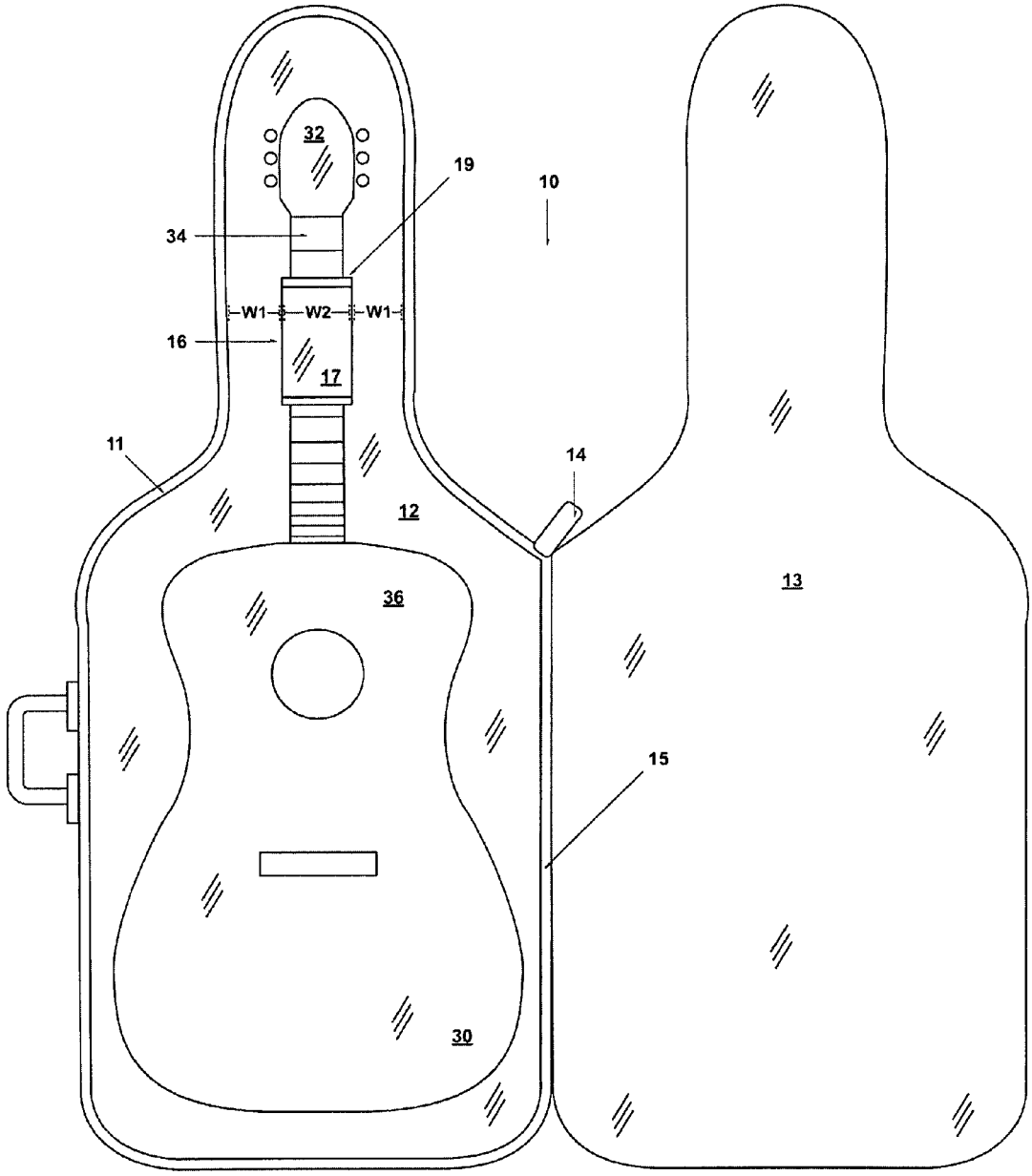
FIG. 2 depicts a top view of another case and instrument in accordance with a different, but related, preferred embodiment of the present invention.

With joint reference to FIG. 1*a* through FIG. 2, there is shown therein several preferred embodiments of the protective instrument case of the present invention. By way of example only, the invention is shown and described with reference to an electric 30 and an acoustic guitar 30'. The guitar(s) 30 shown in the various drawings include(s) a body 36, a contoured neck 34 and a headstock 32. The neck 34 includes a headstock region at one end thereof, a body attachment region at an opposing end and an intermediate region therebetween. However, the protective case according to FIG. 1*a* through FIG. 2 can be used not only for a guitar but also for holding other electric and/or acoustic stringed instruments such as, e.g., double bass, cello, violin, bass-guitar, ukulele, etc. provided that the dimensions and overall shape are appropriate or modified accordingly.

It will be appreciated that one important aspect of the invention is that it provides significant protection of instruments at the (typically) vulnerable neck/headstock joint and does so with very little additional parts/components/materials than a conventional flexible case. In this way, the invention offers the enhanced protection typically associated with a conventional hard-shell case and the convenience and light weight typically associated with a conventional gig-bag.

It should be noted that stringed instrument necks vary greatly from one instrument type to the next. Additionally, neck contours and dimensions of any one type of stringed instrument may vary greatly. Accordingly, another important feature of the invention is that it provides significant protection of instruments almost without regard to the particular neck dimensions and contour of the particular instrument held therein.

The protective instrument case according to the present invention includes a semi-rigid shell 10 with a bottom section 12, a sidewall 11 attached thereto and a cover section 13. The sidewall 11 preferably forms a continuous loop around the perimeter of the bottom 12. The sidewall 11 and the cover 13 are pivotally connected with each other along a first narrow side 15 of the shell 10. Along the remaining outline of the sidewall 11, the sidewall 111 and the cover section 13 may be secured by a suitable fastener 14 which is formed, preferably, as a zip fastener. The fastener/closure mechanism 14 may also take the form of any one or combination of well-known securing mechanisms such as hook and loop fastener(s), a mechanical lock, mechanical latches, one or more snap fasteners, etc. Since cover 13 is hingedly connected to the sidewall 11, the cover 13 may be selectively closed and secured to thereby enclose a region of space between the bottom 12, sidewall 11 and cover 13.

For releasably securing a guitar or other instrument in the protective case, a semi-rigid neck-brace 16 is preferably centered between two portions of the curved sidewall 111 and affixed to the bottom section 12 of the semi-rigid shell 10. The neck-brace 16 is used, primarily, for supporting and firmly grasping the instrument neck 34.

As shown throughout, the neck-brace 16 preferably includes a generally trapezoidal (in side elevation view) semi-rigid block of width W2 and height H2. It is noted that the trapezoidal shape lends itself to even, centered compression during use. For example, a rectilinear block form has the tendency to "lean" to one side under compression. This might best be described as a "mushrooming" effect in the foam. The top surface of neck-brace 16 (meaning the section at the top of the trapezoid that actually comes into contact with the instrument neck) is preferably about 6 inches in length for use with a guitar neck.

In a preferred form of the invention height H2 is selected to be less than or equal to the inside height H1 of sidewall 11 and width W2 is selected to be substantially less than the width W1 of the bottom 12 in the vicinity of the neck-brace 16. Additionally, height H2 is preferably selected to be more than the amount an expected instrument headstock is angled rearwardly and width W2 is preferably selected to be between approximately 1 times and 1.5 times the width of an expected instrument neck in the vicinity of the neck-brace 16. At 1.5 times the width, the guitar neck is encouraged to vertically compress into the center of the foam block, rather then to one side. Selection of W1, W2, H1 and H2 in this way provides for maximum protection of instruments because the neck-brace 16 supports the instrument neck such that the headstock region is suspended in the space enclosed between the bottom and the cover of shell 10. By way of example, extensive empirical studies have resulted the following preferred values for a typical electric guitar case in accordance with the invention W1=2 inches, W2=4 inches, H1=2 inches and H2=2 inches.

In one preferred variant of the invention neck-brace height H2 may be the same as the inner sidewall height (2" for electric guitar and bass). This means there is preferably no space between the cover of the case and the neck-brace inside. In this way, when a guitar is strapped in, there is a "clamping" effect on the instrument. The nature of the high density foam block and the semi-rigid outer shell of the case allows for enough flexibility in the case to do this without putting undue strain on the instrument. This clamping effect helps to stabilize the guitar against the neck-brace and make the instrument feel quite secure inside the case (no shifting around). This clamping effect also helps take some of the burden off of the restraint band in securing the instrument.

The block/body of the neck-brace 16 preferably also includes a deformable neck-engaging layer/portion of memory foam that deforms to the shape of the particular instrument neck secured by the neck-brace. Since the preferred case of the invention may be used with different instruments (each potentially having a different neck contour and/or dimensions) at different times, the deformable layer ensures compatibility with a wide variety of instruments at any one time and over its lifespan. The deformable material may be selected from the group consisting of memory foam, closed cell foam, open cell foam, elastomers, etc., or other technologies including gels, inflatable structures, etc. Nonetheless, where possible, it is also preferred to generally conform the dimensions of the shell 10 to the dimensions of the instrument body 36 to secure the instrument 30 even more.

The neck-brace 16 also includes a retaining band 17 with one free end 18. In one embodiment, band 17 is affixed to the side of neck-brace 16, leaving free end 16 to wrap around to the other side of brace 16. In an alternative embodiment the retaining band 17 is secured to the bottom section 12 beneath neck-brace 16.

The neck-brace 16 is preferably provided with a hook and loop fastener arrangement 21 (such as e.g., a VELCRO® fastener) wherein one element 23 of the VELCRO® fastener is secured on the free end 18 of band 17 and another element 22 of the VELCRO® fastener 21 is secured to the side surface of neck-brace 16. While band 17 may be simply formed with a piece of suitable material (such as a textile—either stretchable or non-stretchable), one optional feature of the band 17 is the use of deformable material on either or both of the band surfaces. For example, the retaining band 17 may be formed of a substantially non-stretchable textile substrate and a layer of deformable material. While deformable material on the neck engaging surface may help band 17 firmly grasp an instrument neck, deformable material on the other surface may help band 17 protect an instrument from impacts against cover 13 (such as if the case fell to a floor face-down). Another optional feature of the band 17 is the addition of a resealable storage pocket 28 that may be accessed whether or not the instrument neck 34 has been secured to the neck-brace 16. The closure means 29 for opening and/or sealing pocket 28 may take the form of any one or combination of well-known closure mechanisms such as a zipper, hook and loop fastener(s), a mechanical lock, mechanical latches, etc.

In order to releasably secure the instrument neck 34 to the neck brace 16 of the shell 10 the instrument is placed in the shell 11, as shown in FIGS. 1*b*, 1*c* and 2, and the band 17 is wrapped around the neck 34 with its free end 18 being fastened to the side of neck-brace 16. In this way, band 17 insures that the guitar is stabilized during the transportation of the case and cannot accidentally fall out when shell 11 is in an opened state.

As used herein, "flexible" generally means capable of substantial deformation without a tendency to break and without a natural tendency to return to its original form. Examples of some flexible shell materials include woven cottons, nylon, cordura, vinyl and other natural or synthetic textiles.

As used herein, "semi-rigid" generally means capable of substantial deformation without a tendency to break but with a natural tendency to return to its original form Examples of some semi-rigid materials include polyurethane, high density and "memory" foams, as well as foams layered with other natural or synthetic textiles.

In accordance with a particularly preferred embodiment of the present invention, at least the bottom section of the case is formed of a semi-rigid material. However, the entire case could also be formed of either flexible or semi-rigid materials or some combination thereof. As a flexible material, a textile or similar material can be used for forming the case. A thick plastic film or vinyl sheet can also be used as a flexible material for forming the case. All of these materials are suitable for use with the neck-brace and/or retaining band, as they can be easily stitched therewith.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

Other than in the operating examples or where otherwise indicated, all numbers or expressions referring to quantities of ingredients, reaction conditions, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

What is claimed is:

1. A gig-bag for a stringed musical instrument having an elongated and contoured neck, the case comprising:

a flexible bottom;

a flexible sidewall of a predetermined height extending from the bottom;

a flexible cover hingedly connected to the sidewall to selectively enclose a region of space between the bottom, sidewall and cover; and a semi-rigid neck-brace to support the instrument neck, the neck-brace having a side that is at least generally trapezoidal in side elevation view and that is at least generally parallel to the direction of the elongated instrument neck, having a height approximately equal to the inner height of the sidewall and being affixed to the bottom.

2. A case as set forth in claim 1 further comprising a retaining band with one free end to releasably fasten the band to the side of the neck-brace.

3. A case as set forth in claim 1, further comprising a retaining band to releasably secure the instrument neck to the neck-brace with a fastener arrangement selected from the group consisting of a zip fastener, a hook and loop fastener and a snap fastener.

4. A case as set forth in claim 3, wherein the portion of the neck-brace that supports the instrument neck is formed of deformable material that conforms to the contour of the neck when the instrument neck is releasably secured to the neck-brace.

5. A case as set forth in claim 4, wherein the deformable portion of the neck-brace is made of memory foam and wherein the retaining band further comprises a layer of deformable material.

6. A case as set forth in claim 3, wherein the retaining band further comprises a resealable storage pocket that is accessible whether or not the instrument neck has been secured to the neck-brace.

7. A case as set forth in claim 1, wherein the instrument neck includes a headstock region at one end, a body attachment region at an opposite end and an intermediate region therebetween; and the neck-brace only supports the instrument neck in the intermediate region.

8. A protective case for a stringed musical instrument having a contoured neck with a headstock region at one end, a body attachment region at an opposite end and an intermediate region therebetween, the case comprising:

a semi-rigid bottom;

a semi-rigid sidewall of a predetermined height extending from the bottom;

a semi-rigid cover hingedly connected to the sidewall to selectively enclose a region of space between the bottom, sidewall and cover;

a semi-rigid neck-brace with a top surface, the neck-brace being affixed to the bottom and having a height equal to or less than the height of the sidewall such that the top surface of the neck-brace supports the intermediate region of the instrument neck and the headstock region is suspended in the space enclosed between the bottom and the cover; and at least one retaining band to realeasably secure the instrument neck to the top surface of the neck-brace, the retaining band including a resealable storage pocket that is accessible whether or not the instrument neck has been secured to the neck-brace.

9. A case as set forth in claim 8, wherein the retaining band releasably secures the instrument neck to the top surface of the neck-brace with a fastener arrangement selected from the group consisting of a zip fastener, a hook and loop fastener and a snap fastener.

10. A case as set forth in claim 8, wherein the portion of the neck-brace that supports the instrument neck is formed of deformable material that conforms to the contour of the neck when the instrument neck is releasably secured to the neck-brace.

11. A case as set forth in claim 8, wherein the neck-brace is generally trapezoidal in side elevation view and the deformable portion of the neck-brace is made of memory foam.

12. A case as set forth in claim 8, wherein the at least one retaining band is formed of a substantially non-stretchable textile substrate and a layer of deformable material.

13. A case as set forth in claim 8, further comprising another retaining band spaced from the at least one retaining band to secure the instrument neck to the top surface of the neck-brace at two locations spaced from each other.

14. A protective case for a stringed musical instrument having a neck with a headstock region at one end, a body attachment region at an opposite end and an elongated intermediate region therebetween, the case comprising:

a semi-rigid bottom;

a semi-rigid sidewall of a predetermined height extending from the bottom;

a semi-rigid cover hingedly connected to the sidewall to selectively enclose a region of space between the bottom, sidewall and cover;

neck-brace means for supporting the intermediate region of the instrument neck whereby the headstock region is suspended in the region of space enclosed between the bottom and the cover, the neck-brace means having a side that is at least generally trapezoidal in side elevation view and that is at least generally parallel to the direction of the elongated intermediate region of the neck; and retaining means for releasably securing the intermediate region of the instrument neck to the neck-brace.

15. A case as set forth in claim 14 wherein the neck-brace means is at least partially formed of deformable material that conforms to the contour of the neck when the neck is releasably secured to the neck-brace.

16. A case as set forth in claim 15 wherein the deformable material is selected from the group consisting of memory foam, closed cell foam, open cell foam and elastomers.

17. A case as set forth in claim 15 wherein the neck-brace means comprises a semi-rigid neck-brace affixed to the bottom with a height that is approximately equal to the inside height of the sidewall and a width that is substantially less than the width of the bottom in the vicinity of the neck-brace.

18. A case as set forth in claim 14 wherein the retaining means comprises a retaining band affixed to the neck-brace means and having one free end that releasably fastens the band to the neck-brace means.

19. A case as set forth in claim 18 wherein the retaining means further comprises a resealable storage pocket that is accessible whether or not the instrument neck has been secured to the neck-brace means.

20. A case as set forth in claim 14, wherein the retaining means is formed of a substantially non-stretchable textile substrate and the width of the neck-brace means is about 1.5 times the width of the instrument neck.

* * * * *